United States Patent [19]

Greenfield et al.

[11] Patent Number: 4,859,543

[45] Date of Patent: Aug. 22, 1989

[54] EARTH WORKING TOOL HAVING A WORKING ELEMENT FABRICATED FROM CEMENTED TUNGSTEN CARBIDE COMPOSITIONS WITH ENHANCED PROPERTIES

[75] Inventors: Mark S. Greenfield, Carey, N.C.; Edward V. Conley, Irwin, Pa.

[73] Assignee: Kennametal Inc., Latrobe, Pa.

[21] Appl. No.: 43,569

[22] Filed: Apr. 28, 1987

[51] Int. Cl.[4] ..... B22F 3/00

[52] U.S. Cl. ..... 428/552; 75/240; 51/DIG. 26; 175/409; 428/564

[58] Field of Search ..... 175/409; 75/240; 428/564, 552; 51/DIG. 26

[56] References Cited

U.S. PATENT DOCUMENTS

| | | | |
|---|---|---|---|
| 2,113,171 | 4/1938 | Cooper | 75/240 |
| 2,731,711 | 1/1956 | Lucas | 75/240 |
| 3,165,822 | 1/1965 | Beeghly | 75/240 |
| 3,379,503 | 4/1968 | McKenna | 23/208 |
| 3,449,685 | 3/1970 | Kniff | 299/86 |
| 3,451,791 | 6/1969 | Meadows | 75/240 |
| 3,519,309 | 7/1970 | Engle et al. | 299/86 |
| 3,660,050 | 5/1972 | Iler et al. | 75/240 |
| 3,677,722 | 7/1972 | Rymas | 75/240 |
| 3,720,273 | 3/1973 | McKenrey et al. | 175/335 |
| 4,013,460 | 3/1977 | Brown et al. | 75/240 |
| 4,024,902 | 5/1977 | Baum | 75/240 |
| 4,216,832 | 8/1980 | Stephenson . | |
| 4,316,636 | 2/1982 | Taylor et al. | 299/92 |
| 4,359,335 | 11/1982 | Garner . | |
| 4,497,520 | 2/1985 | Ojanen | 299/86 |
| 4,561,698 | 12/1985 | Beebe | 37/142 R |
| 4,575,156 | 3/1986 | Hunter et al. | 37/142 R |

FOREIGN PATENT DOCUMENTS

| | | |
|---|---|---|
| 3005684 | 8/1981 | Fed. Rep. of Germany . |
| 2343855 | 10/1977 | France . |
| 2017153 | 10/1979 | United Kingdom . |

OTHER PUBLICATIONS

Kalish, H. S. et al, "How Composition Affects the Properties and Performance of Cemented Carbide Cutting Tools," Metal Progress, Jun. 1979, pp. 64–70.

Kalish, H. S., "Some Plain Talk About Carbides," Manufacturing Engineering and Management, pp. 28–31, Jul. 1973.

"Kennametal Carbide Grades" (Published 1983).

"Carbide Components" (Published 1982).

"Kennametal Carbide Application Data—Kennametal Grade K3404", Kennametal Grade K6T, Kennametal Grade K3411, Kennametal Grade K3560 (1983).

"Kennametal Coal Tools—Longwall Bits" (1985) KR-225 and KR-300.

"Tooling Systems for Road Heading and Mining Machines" (1986).

*Primary Examiner*—Stephen J. Lechert, Jr.

*Attorney, Agent, or Firm*—John J. Prizzi

[57] ABSTRACT

An earth working tool, such as a mining and construction cutter bit, has an elongated body, and a working element, such as a hard tip attached on a forward end of the body. The working element or hard tip is fabricated of a composition of essentially tungsten carbide of large grain size. The composition has one of a plurality of different percents, X, by weight of cobalt as a binder and one of a plurality of different Rockwell A scale hardnesses, Y. The cobalt percents X and hardnesses Y are paired in sets and have nominal values which satisfy the relationship:

$$Y=91-0.62X,$$

where X is selected from within a range of from about 4.2 to 12.0 percent. Also, the values of Y in the sets of X and Y have upper and lower limits which satisfy the respective relationships:

$$Y=91.1-0.57X \text{ and } Y=90.0-0.67X,$$

where X is selected from the aforementioned range of from about 4.2 to 12.0 percent. More particularly, each composition has one set of cobalt percent X and hardness Y values selected from a plurality of different sets of (X, Y) as follows: (4.5+/−0.3, 88.2+/−0.3), (5.0+/−0.3, 87.9+/−0.3), (8.5+/−0.5, 85.8+/−0.5) and (10.5+/−0.5, 84.5+/−0.6).

12 Claims, 2 Drawing Sheets

EARTH WORKING TOOL HAVING A WORKING ELEMENT FABRICATED FROM CEMENTED TUNGSTEN CARBIDE COMPOSITIONS WITH ENHANCED PROPERTIES

BACKGROUND OF THE INVENTION

1. Field of the Invention

The present invention relates generally to earth working tools and, more particularly, is concerned with such a tool having a working element composed of a large grain, low cobalt tungsten carbide composition with enhanced physical properties.

2. Description of the Prior Art

Many mining and construction tools employ drums, cutter chains, and the like on which are mounted a multiplicity of cutter bits. Representative of the prior art are the cutter bits disclosed in U.S. Pat. Nos. to Kniff (3,499,685), Engle et al (3 519,309), McKenry et al (3,720,273), Stephenson (4,216,832), Taylor et al (4,316,636) and Ojanen (4,497,520). In the course of operating these tools, the bits are forcibly engaged with coal and rock formations to reduce and remove the same and thus are subjected to a high degree of stress and wear. Typically, each bit has a hard, wear resistant, insert or tip which contacts the formation. Heretofore, hard tips have been composed of any one of several different grades of cemented tungsten carbide composition available from Kennametal Corporation, such as grades identified as K-6T and K-3560.

The most expensive part of the cutter bit is its hard tip. Typically, over half of the cost of the bit resides in the tip. Thus, it is highly desirable to be able to use the tip as long as possible, i.e., to maximize its useful life. Early replacement increases operating costs due to increased tool downtime and usage of replacement parts and maintenance labor. While the grades of cemented tungsten carbide composition used heretofore in mining and construction applications, such as the above-identified Kennametal K-6T and K-3560, have been highly successful, there is an ongoing need for improvements in bit construction directed toward enhancement of the physical properties of the material composing the tip, with the objective being to extend the life of the bit and thereby reduce operating costs.

SUMMARY OF THE INVENTION

The present invention provides an earth working tool, such as a mining/construction cutter bit having a working element, such as a hard tip, fabricated of enhanced compositions of cemented tungsten carbide designed to satisfy the aforementioned needs. The advantages of the enhanced compositions of cemented tungsten carbide over the conventional Kennametal K-6T and K-3560 compositions are improved wear resistance fracture toughness. It is well documented that as grain size increases fracture toughness increases. It is also documented that as the percent of cobalt decreases the wear resistance increases. These new enhanced compositions of the present invention contain larger grain size tungsten carbide crystals and lower cobalt contents than were traditionally available. Some degradation of transverse rupture strength is experienced with these new enhanced compositions, thus limiting their use to applications where fracture toughness and wear resistance are paramount.

Although mining and construction tools are used as an example herein, the principles of the present invention are equally applicable to the working element of any earth working tool, such as, but not limited to, snowplow blades, grader blades, and the like.

Accordingly, the present invention is directed to an earth working tool which comprises: (a) an elongated body; and (b) a working element attached on a forward end of the body wherein the working element is fabricated of a composition of essentially tungsten carbide of large grain size and having one of a plurality of different percents, X, by weight of cobalt as a binder and one of a plurality of different Rockwell A scale hardnesses, Y. The cobalt percents X and hardnesses Y of the respective compositions are paired in sets and have nominal values which satisfy the relationship:

$$Y=91-0.62X,$$

where X is selected from within a range of from about 4.2 to 12.0 percent. Also, the values of Y in the sets of X and Y have upper and lower limits which satisfy the respective relationships:

$$Y=91.1-0.57X \text{ and } Y=90.9-0.67X,$$

where X is selected from the aforementioned range of from about 4.2 to 12.0 percent.

More particularly, each composition has one set of cobalt percent X and hardness Y values selected from a plurality of different sets of (X, Y) as follows: (4.5±0.3, 88.2±0.3), (5.0±0.3, 87.9±0.3), (8.5±0.5, 85.8±0.5) and (10.5±0.5, 84.5±0.6).

These and other advantages and attainments of the present invention will become apparent to those skilled in the art upon a reading f the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
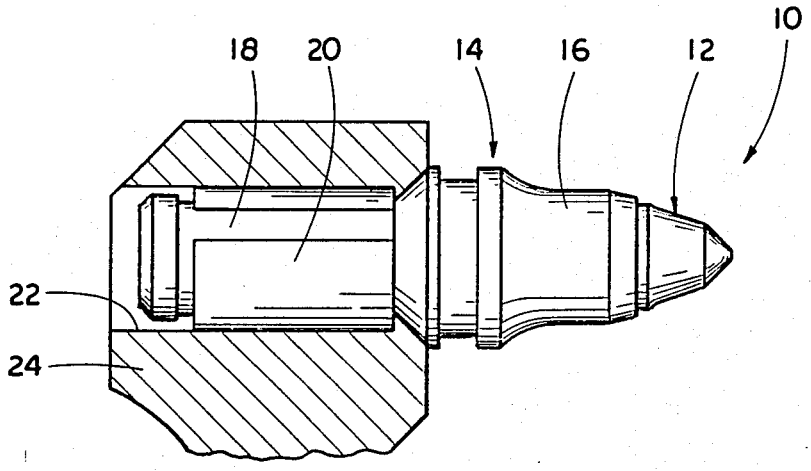
FIG. 1 is a side elevational view of a cutter bit being mounted on a block and having a hard tip constructed in accordance with the present invention.

In the following description, like reference characters designate like or corresponding parts. Also in the following description, it is to be understood that such terms as "forward", "rearward", "left", "right", "upwardly", "downwardly", and the like, are words of convenience and are not to be construed as limiting terms.

Referring now to the drawings, and particularly to FIG. 1, there is shown an earth working tool, such as a cutter bit, generally designated by the numeral 10, which can be mounted in a conventional manner on tools (not shown) intended for use in applications such as mining and construction. The cutter bit 10 includes a working element, such as a hard pointed insert or tip 12 and an elongated bit body 14. The body 14 has a forward body portion 16 and a rearward shank portion 18 which are constructed as a single piece of steel. A cylindrical retention spring 20, which is longitudinally slotted and made of resilient material, encompasses the shank portion 18 of the bit 10 and adapts the bit for mounting in a socket 22 of a block 24 which is, in turn, mounted on a drum (not shown). The retention spring 20 tightly engages the socket 22 and loosely engages the bit shank portion 18, allowing the bit to rotate during use In accordance with the present invention, the working element or hard tip 12 is fabricated of any one of four different compositions of cemented tungsten carbide. Each of the compositions are essentially tungsten carbide (WC) of large or coarse grain size, but with different sets of percents, X, by weight of cobalt (Co) as a binder and of Rockwell A scale hardnesses, Y, having the relationship as depicted graphically in FIG. 2. The compositions are made by a conventional process, generally involving the steps of blending WC and Co together with binders added to form a graded powder. This powder is then compacted and sintered by conventional powder metallurgical techniques to produce a hard insert For a detailed understanding of the process for manufacturing large or coarse WC powder, reference should be made to U.S. Pat. No. 3,379,503. An improved process is described in a pending application filed Dec. 16, 1986, granted U.S. Ser. No. 942,333 and entitled "MACROCRYSTALLINE TUNGSTEN MONOCARBIDE POWDER AND PROCESS FOR PRODUCING".

More particularly, the cobalt percents X and hardnesses Y which define the tungsten carbide compositions are paired in sets and have nominal values which satisfy the relationship:

$$Y=91-0.62X,$$

where X is selected from within a range of from about 4.2, to 12.0 percent. Also, the values of Y in the sets of X and Y have upper and lower limits which satisfy the respective relationships:

$$Y=91.1-0.57X \text{ and } Y=90.9-0.67X,$$

where X is selected from the aforementioned range of from about 4.2 to 12.0 percent. These mathematical relationships, which will be developed below, are determined by using the slope-intercept equation of a straight line, $y=mx+b$, to define the upper limit line, the nominal line and the lower limit line plotted in the graph of FIG. 2 based on the laboratory test data of cobalt content, X, and Rockwell A scale (Ra) hardness, Y, as follows:

TABLE I

| | Percent Cobalt | | Ra Hardness |
|---|---|---|---|
| * | 4.5 +/− 0.3 | E-972 | 88.2 +/− 0.3 |
| * | 5.0 +/− 0.3 | E-973 | 87.9 +/− 0.3 |
| | 5.7 +/− 0.4 | | 87.5 +/− 0.3 |
| | 6.5 +/− 0.5 | | 87.0 +/− 0.4 |
| | 7.5 +/− 0.5 | | 86.4 +/− 0.5 |
| * | 8.5 +/− 0.5 | E-951 | 85.8 +/− 0.5 |
| | 9.5 +/− 0.5 | | 85.1 +/− 0.6 |
| * | 10.5 +/− 0.5 | E-1061 | 84.5 +/− 0.6 |
| | 11.5 +/− 0.5 | | 83.9 +/− 0.7 |

The "*" designates the four tungsten carbide compositions of the present invention, which are identified respectively as E-972, E-973, E-951 and E-1061 in Table I. From Table I, it will be seen that each composition, E-972, E-973, E-951 and E-1061, has one set (X, Y) of cobalt percent X and hardness Y values as follows: (4.5±0.3, 88.2±0.3), (5.0±0.3, 87.9±0.3), (8.5±0.5, 85.8±0.5) and (10.5±0.5, 84.5±0.6).

Figure 2:
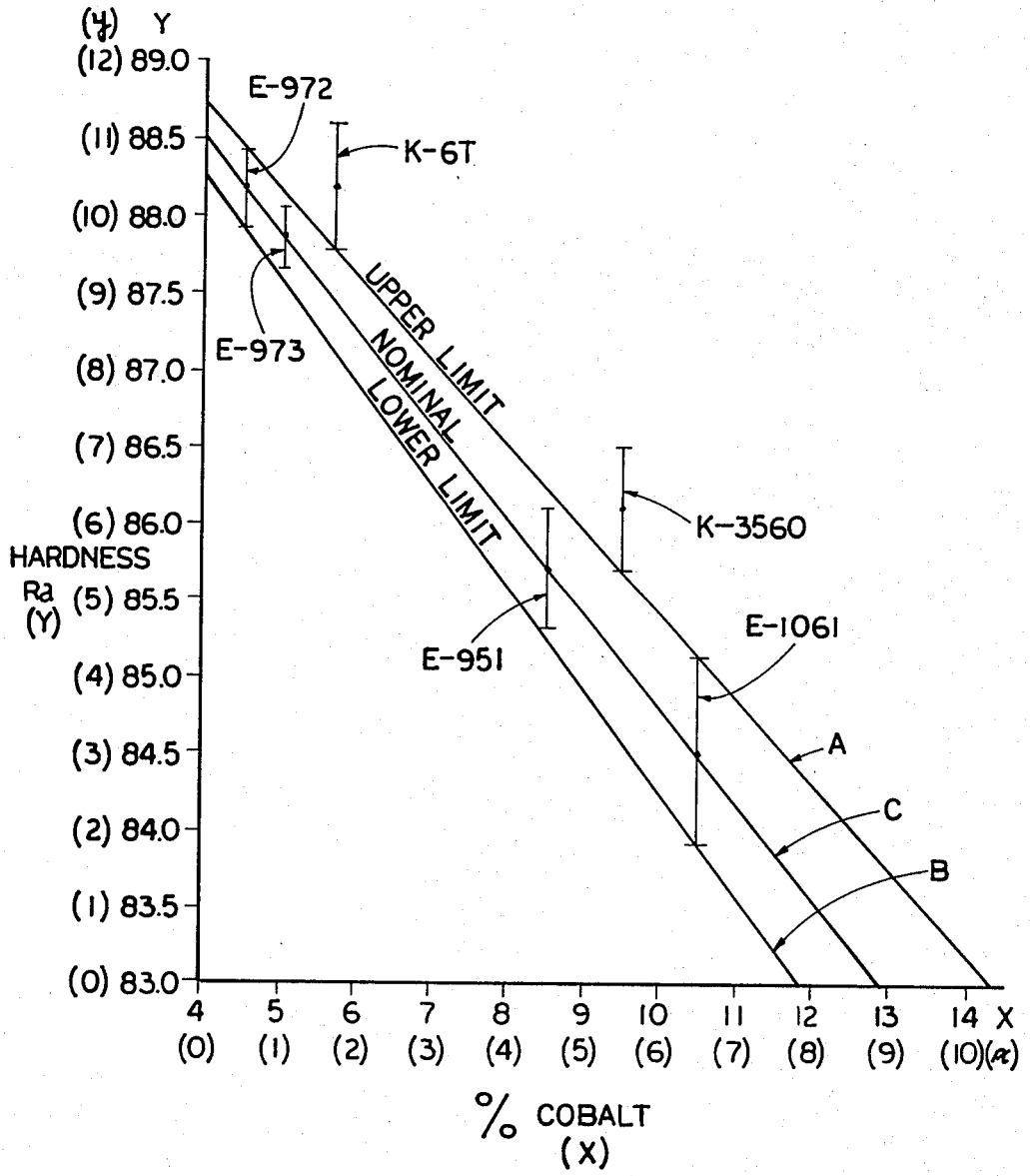
FIG. 2 is a graph depicting the relationship between Rockwell A scale hardness (Ra) and percent cobalt by weight of the compositions used in the cutter bit tip which have the enhanced physical properties.

The relationship between X and Y for the upper limit line, A, in FIG. 2 is developed as follows. The (x,y) coordinates of the E-972 and E-1061 compositions, (0.5,11) and (6.5,4.2), were used to determine the slope of the upper limit line. It will be noted that these (x,y) coordinates correspond to (X,Y) coordinates for the same two compositions of (4.5,88.5) and (10.5,85.1). Since the equation for the slope, m, is $m=(y'-y)/(x'-x)$, then the slope $(11-4.2)/(0.5-6.5)$ or $-1.13$. The straight line equation is $y=mx+b$, where b is the y axis intercept. Thus, $y=-1.113x+11.5$, since as seen in FIG. 2, b is approximately equal to 11.5 for line A. However, in the graph of FIG. 2, y is related to Y and x is related to X as follows: $y=(Y-83)/0.5$, and $x=X-4$. So, substituting for y and x in the straight line equation, $y=-1.113x+11.5$, gives $$(Y-83)/0.5=-1.13(X-4)+11.5$$

which reduces down to the following relationship between X and Y for the upper limit line:

$$Y=91.1-0.57X.$$

Next, the relationship between X and Y for the lower limit line, B, in FIG. 2 is developed as follows. The (x,y) coordinates of the E-972 and E-1061 compositions, (0.5,9.8) and (6.5,1.8), were used to determine the slope of the lower limit line. It will be noted that these (x,y) coordinates correspond to (X,Y) coordinates for the same two compositions of (4.5,87.9) and (10.5,83.9). Now, the slope of the lower limit line equals $(9.8-1.8)/(0.5-6.5)$ or $-1.33$. The straight line equation is $y=-1.33x+10.5$, since as seen in FIG. 2, b is approximately equal to 10.5 for line B. Now, substituting for y and x in the straight line equation, $Y=-1.33x+10.5$, gives $$(Y-83)/0.5=-1.33(X-4)+10.5$$

which reduces down to the following relationship between X and Y for the lower limit line:

$$Y=90.9-0.67X.$$

Finally, the relationship between X and Y for the nominal line, C, in FIG. 2 is developed as follows. The (x,y) coordinates of the E-972 and E-1061 compositions, (0.5,10.4) and (6.5,3), were used to determine the slope of the nominal line It will be noted that these (x,y) coordinates correspond to (X,Y) coordinates for the same two compositions of (4.5,88.2) and (10.5,84.5). Now, the slope of the nominal line equals $(10.4-3)/(0.5-6.5)$ or $-1.23$. The straight line equation is $y=-1.23x+11$, since as seen in FIG. 2, b is approximately equal to 11 for line C. Now, substituting for y and x in the straight line equation, $y=-1.23x+11$, gives $$(Y-83)/0.5=-1.23(X-4)+11$$

which reduces down to the following relationship between X and Y for the nominal line:

$$Y=91-0.62X.$$

The commonality between the different selected compositions of the present invention is that the tungsten carbide of each has an extremely coarse grain size. While the grain size is not defined herein with any greater specificity than to say that it is large or coarse, it is not necessary to be more precise than that since the cobalt content by weight and the Rockwell A scale hardness of the compositions are precisely defined above. One skilled in the art will readily understand what the grain size of the cemented tungsten carbide compositions have to be in view of the specified values of the cobalt content and hardness of the compositions.

The enhanced physical properties of the four different compositions are increased fractural toughness and increased wear resistance, making them particularly adapted for use in fabrication of working elements of bit tips for mining and construction applications as well as the working elements of other earth working tools. The fractural toughness is closely related and inversely proportional to the hardness. The reduced cobalt contents of the compositions has the effect of lowering their material costs and increasing their respective hardnesses. However, since by increasing the grain size the hardness decreases, this is balanced against the effect of reducing the cobalt content to give the desired hardness.

In FIG. 2, it will be noted that the prior art compositions identified as K-6T and K-3560 have (X,Y) sets of values of (5.7, 88.2) and (9.5, 86.2) respectively. These sets of values are generally above the upper limit line A and these do not satisfy the aforementioned relationships. Also, the four compositions of the present invention can be identified by the coercive force (C.F.) of each. The C.F. is the magnetic field which must be applied to a magnet material in a symmetrical, cyclicly magnetized fashion, to make the magnetic induction vanish. For composition E-972, C.F. is 68 oerstead; for composition E-973, C.F. is 45–70 oerstead; for E-951, C.F. is 40–60 oerstead; and for E-1061, C.F. is 40–55 oerstead In the case of the prior art K-6T composition, its C.F. is 50–80 oerstead.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

We claim:

1. An earth working tool, comprising:
(a) an elongated/body; and
(b) a working element attached on a forward end of said body and being fabricated of a composition of essentially tungsten carbide of large grain size, said composition having 4.5±0.3 percent by weight of cobalt as a binder and a Rockwell A scale hardness of 88.2±0.3.

2. An earth working tool, comprising:
(a) an elongated body; and
(b) a working element attached on a forward end of said body and being fabricated of a composition of essentially tungsten carbide of large grain size, said composition having 5.0±0.3 percent by weight of cobalt as a binder and a Rockwell A scale hardness of 87.9±0.3.

3. An earth working tool, comprising:
(a) an elongated body; and
(b) a working element attached on a forward end of said body and being fabricated of a composition of essentially tungsten carbide of large grain size, said composition having 8.5±0.5 percent by weight of cobalt as a binder and a Rockwell A scale hardness of 85.8±0.5.

4. An earth working tool, comprising:
(a) an elongated body; and
(b) a working element attached on a forward end of said body and being fabricated of a composition of essentially tungsten carbide of large grain size, said composition having 10.5±0.5 percent by weight of cobalt as a binder and a Rockwell A scale hardness of 84.5±0.6.

5. An earth working tool, comprising:
(a) an elongated body; and
(b) a working element attached on a forward end of said body and being fabricated of a composition of essentially tungsten carbide of large grain size, said composition having one of a plurality of different percents, X, by weight of cobalt as a binder and one of a plurality of different Rockwell A scale hardnesses, Y, wherein said cobalt percents X and hardnesses Y are paired in sets, (X, Y), as follows: (4.5±0.3, 88.2±0.3), (5.0±0.3, 87.9±0.3), (8.5±0.5, 85.8±0.5) and (10.5±0.5, 84.5±0.6).

6. An earth working tool comprising:
(a) an elongated body;
(b) an earth working element on a forward end of said body and composed of a composition consisting essentially of tungsten carbide grains cemented together by a cobalt binder and
(c) wherein the weight percent of cobalt, X, in said composition is from about 4.2 to 12.0 and the hardness, Y, of said composition has an upper limit defined by the relationship $Y=91.1-0.57X$ and a lower limit defined by the relationship $Y=90.9-0.67X$.

7. The earth working tool according to claim 6 having a nominal hardness, Y, defined by the relationship $Y=91-0.62X$.

8. An earth working tool, comprising:
(a) an elongated body; and
(b) a cemented tungsten carbide earth working element on a forward end of said body and having a composition consisting essentially of tungsten carbide grains and 5.3 to 6.1 percent by weight of cobalt as a binder and wherein said cemented tungsten carbide earth working element has a Rockwell A scale hardness of 87.2 to 87.8.

9. An earth working tool, comprising:
(a) an elongated body; and
(b) a cemented tungsten carbide earth working element on a forward end of said body and having a composition consisting essentially of tungsten carbide grains and 6.0 to 7.0 percent by weight of cobalt as a binder, and wherein said cemented tungsten carbide earth working element has a Rockwell A scale hardness of 86.6 to 87.4.

10. An earth working tool, comprising:
(a) an elongated body; and
(b) a cemented tungsten carbide earth working element on a forward end of said body and having a composition consisting essentially of tungsten carbide grains and 7.0 to 8.0 percent by weight of cobalt as a binder, and wherein said cemented tungsten carbide earth working element has a Rockwell A scale hardness of 85.9 to 86.9.

11. An earth working tool, comprising:

(a) an elongated body; and (b) a cemented tungsten carbide earth working element on a forward end of said body and having a composition consisting essentially of tungsten carbide grains and 9.0 to 10.0 percent by weight of cobalt as a binder, and wherein said cemented tungsten carbide earth working element has a Rockwell A scale hardness of 84.5 to 85.7.

12. An earth working tool, comprising:

(a) an elongated body;

(b) a cemented tungsten carbide earth working element on a forward end of said body and having a composition consisting essentially of tungsten carbide grains and 11.0 to 12.0 percent by weight of cobalt as a binder and wherein said cemented tungsten carbide earth working element has a Rockwell A scale hardness of 83.2 to 84.6.

* * * * *

UNITED STATES PATENT AND TRADEMARK OFFICE

CERTIFICATE OF CORRECTION

PATENT NO. : 4,859,543

DATED : August 22, 1989

INVENTOR(S) : Mark S. Greenfield and Edward V. Conley

It is certified that error appears in the above—identified patent and that said Letters Patent is hereby corrected as shown below:

The title page should be deleted to appear as per attached title page.

In the Drawings, sheet 1, Figure 1, the socket 22 should appear as follows:

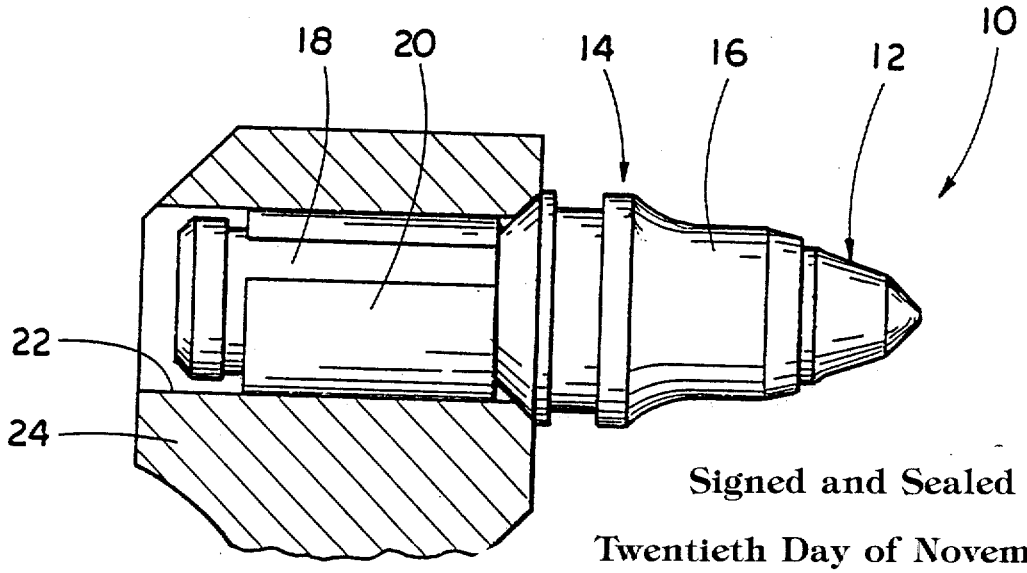

Signed and Sealed this

Twentieth Day of November, 1990

*Attest:*

*Attesting Officer*

HARRY F. MANBECK, JR.

*Commissioner of Patents and Trademarks*

United States Patent [19]

Greenfield et al.

[11] Patent Number: 4,859,543

[45] Date of Patent: Aug. 22, 1989

[54] EARTH WORKING TOOL HAVING A WORKING ELEMENT FABRICATED FROM CEMENTED TUNGSTEN CARBIDE COMPOSITIONS WITH ENHANCED PROPERTIES

[75] Inventors: Mark S. Greenfield, Carey, N.C.; Edward V. Conley, Irwin, Pa.

[73] Assignee: Kennametal Inc., Latrobe, Pa.

[21] Appl. No.: 43,569

[22] Filed: Apr. 28, 1987

[51] Int. Cl.[4] ..... B22F 3/00

[52] U.S. Cl. ..... 428/552; 75/240; 51/DIG. 26; 175/409; 428/564

[58] Field of Search ..... 175/409; 75/240; 428/564, 552; 51/DIG. 26

[56] References Cited

U.S. PATENT DOCUMENTS

| | | | |
|---|---|---|---|
| 2,113,171 | 4/1938 | Cooper | 75/240 |
| 2,731,711 | 1/1956 | Lucas | 75/240 |
| 3,165,822 | 1/1965 | Beeghly | 75/240 |
| 3,379,503 | 4/1968 | McKenna | 23/208 |
| 3,449,685 | 3/1970 | Kniff | 299/86 |
| 3,451,791 | 6/1969 | Meadows | 75/240 |
| 3,519,309 | 7/1970 | Engle et al. | 299/86 |
| 3,660,050 | 5/1972 | Iler et al. | 75/240 |
| 3,677,722 | 7/1972 | Rymas | 75/240 |
| 3,720,273 | 3/1973 | McKenrey et al. | 175/335 |
| 4,013,460 | 3/1977 | Brown et al. | 75/240 |
| 4,024,902 | 5/1977 | Baum | 75/240 |
| 4,216,832 | 8/1980 | Stephenson . | |
| 4,316,636 | 2/1982 | Taylor et al. | 299/92 |
| 4,359,335 | 11/1982 | Garner . | |
| 4,497,520 | 2/1985 | Ojanen | 299/86 |
| 4,561,698 | 12/1985 | Beebe | 37/142 R |
| 4,575,156 | 3/1986 | Hunter et al. | 37/142 R |

FOREIGN PATENT DOCUMENTS

| | | |
|---|---|---|
| 3005684 | 8/1981 | Fed. Rep. of Germany . |
| 2343855 | 10/1977 | France . |
| 2017153 | 10/1979 | United Kingdom . |

OTHER PUBLICATIONS

Kalish, H. S. et al, "How Composition Affects the Properties and Performance of Cemented Carbide Cutting Tools," Metal Progress, Jun. 1979, pp. 64–70.

Kalish, H. S., "Some Plain Talk About Carbides," Manufacturing Engineering and Management, pp. 28–31, Jul. 1973.

"Kennametal Carbide Grades" (Published 1983).

"Carbide Components" (Published 1982).

"Kennametal Carbide Application Data—Kennametal Grade K3404", Kennametal Grade K6T, Kennametal Grade K3411, Kennametal Grade K3560 (1983).

"Kennametal Coal Tools—Longwall Bits" (1985) KR-225 and KR-300.

"Tooling Systems for Road Heading and Mining Machines" (1986).

*Primary Examiner*—Stephen J. Lechert, Jr.

*Attorney, Agent, or Firm*—John J. Prizzi

[57] ABSTRACT

An earth working tool, such as a mining and construction cutter bit, has an elongated body, and a working element, such as a hard tip attached on a forward end of the body. The working element or hard tip is fabricated of a composition of essentially tungsten carbide of large grain size. The composition has one of a plurality of different percents, X, by weight of cobalt as a binder and one of a plurality of different Rockwell A scale hardnesses, Y. The cobalt percents X and hardnesses Y are paired in sets and have nominal values which satisfy the relationship:

$$Y=91-0.62X.$$

where X is selected from within a range of from about 4.2 to 12.0 percent. Also, the values of Y in the sets of X and Y have upper and lower limits which satisfy the respective relationships:

$$Y=91.1-0.57X \text{ and } Y=90.0-0.67X.$$

where X is selected from the aforementioned range of from about 4.2 to 12.0 percent. More particularly, each composition has one set of cobalt percent X and hardness Y values selected from a plurality of different sets of (X, Y) as follows: (4.5+/−0.3, 88.2+/−0.3), (5.0+/−0.3, 87.9+/−0.3), (8.5+/−0.5, 85.8+/−0.5) and (10.5+/−0.5, 84.5+/−0.6).

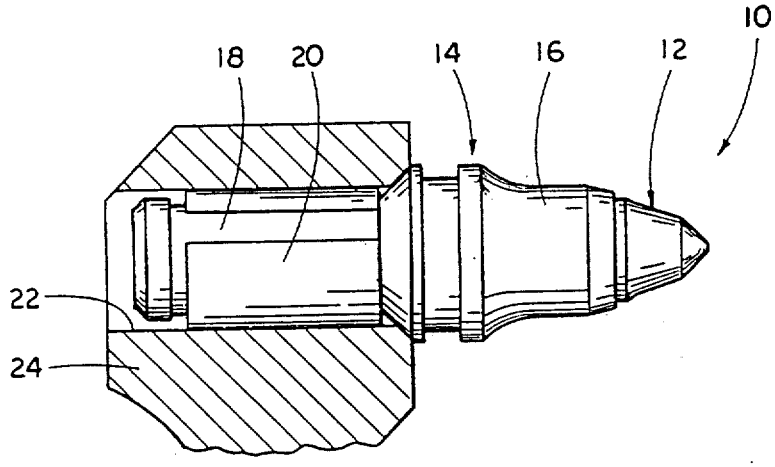

12 Claims, 2 Drawing Sheets